US007174818B1

(12) United States Patent
Cutler et al.

(10) Patent No.: US 7,174,818 B1
(45) Date of Patent: Feb. 13, 2007

(54) CLICK-TYPE TORQUE WRENCH AND IMPROVED CAM ASSEMBLY THEREFOR

(75) Inventors: Brian Cutler, Rowland Heights, CA (US); William D. Riehle, Sedona, AZ (US)

(73) Assignee: Snap-on Incorporated, Kenosha, WI (US)

( * ) Notice: Subject to any disclaimer, the term of this patent is extended or adjusted under 35 U.S.C. 154(b) by 157 days.

(21) Appl. No.: 10/962,332

(22) Filed: Oct. 8, 2004

Related U.S. Application Data

(60) Provisional application No. 60/510,704, filed on Oct. 10, 2003.

(51) Int. Cl.
*B25B 23/159* (2006.01)
*B25B 23/14* (2006.01)
*B25B 23/142* (2006.01)

(52) U.S. Cl. ..... 81/483; 81/467; 81/478

(58) Field of Classification Search ..... 81/483, 81/52.5, 467, 478, 489, 481
See application file for complete search history.

(56) References Cited

U.S. PATENT DOCUMENTS

| | | | | | |
|---|---|---|---|---|---|
| 609,427 | A * | 8/1898 | Bergovist | 223/111 |
| 2,306,363 | A * | 12/1942 | Roth | 192/12 R |
| 2,743,638 | A | 5/1956 | Woods | |
| 3,577,815 | A | 5/1971 | Bergquist | |
| 3,581,606 | A * | 6/1971 | Grabovac | 81/483 |
| 3,584,895 | A | 6/1971 | Uemura | |
| 3,599,515 | A * | 8/1971 | Grabovac | 81/483 |
| 3,633,445 | A | 1/1972 | Aijala | |
| 3,772,942 | A | 11/1973 | Grabovac | |
| 3,893,354 | A * | 7/1975 | Knoll | 81/483 |
| 4,126,062 | A | 11/1978 | Solomon | |
| 4,316,397 | A | 2/1982 | Skidmore et al. | |
| 4,467,678 | A | 8/1984 | Lindholm | |
| 4,532,836 | A | 8/1985 | Grabovac | |
| 4,714,008 | A | 12/1987 | Bowers | |
| 4,732,062 | A | 3/1988 | Grabovac et al. | |
| 5,129,293 | A | 7/1992 | Larson et al. | |
| 5,244,284 | A | 9/1993 | Larson et al. | |
| 5,394,775 | A | 3/1995 | Fagerstrom | |
| 5,435,190 | A | 7/1995 | Jansson et al. | |
| 5,497,682 | A | 3/1996 | Hsu | |
| 5,503,042 | A | 4/1996 | Larson et al. | |
| 5,911,801 | A * | 6/1999 | Fravalo et al. | 81/478 |
| 6,463,834 | B2 | 10/2002 | Kemp et al. | |
| 2003/0084759 | A1 * | 5/2003 | Carini | 81/492 |

* cited by examiner

*Primary Examiner*—Lee D. Wilson
*Assistant Examiner*—Alvin J. Grant
(74) *Attorney, Agent, or Firm*—Seyfarth Shaw LLP

(57) ABSTRACT

A cam assembly for a click-type torque wrench includes an elongated plunger body having opposed ends and having a deep cavity formed axially in one end and terminating at an end face disposed with intermediate the ends, the end face having a cam seat formed therein and extending laterally theracross and having opposed sloping side cam surfaces. A sleeve may be disposed about the cam plunger for sliding engagement within a tubular lever arm of the torque wrench. The cam seat cooperates with an end of the wrench pivot arm for trapping therebetween the wrench trip block.

11 Claims, 3 Drawing Sheets

CLICK-TYPE TORQUE WRENCH AND IMPROVED CAM ASSEMBLY THEREFOR

RELATED APPLICATION

This application claims the benefit of the filing date of now abandoned U.S. Provisional Application No. 60/510,704, filed Oct. 10, 2003.

BACKGROUND

This application relates to torque wrenches of the click type and, in particular, to click mechanisms for such wrenches.

Click-type torque wrenches derive their name from the fact that they signal the achievement of a predetermined torque level by generating an audible and/or tactile "click." Such torque wrenches typically have an elongated tubular lever arm coupled at one end to a workpiece-engaging head by a pivot arm which extends into the tube, a handle being provided at the other end of the tube. The click mechanism includes a spring-loaded cam plunger which is slidably disposed within the tube and is biased toward the inner end of the pivot arm, for trapping therebetween a trip block or pawl which is seated in recesses formed in the facing ends of the pivot arm and cam plunger. The spring force, which is adjustable, drives the trip block axially against the inner end of the pivot arm so as to hold the pivot arm in a position aligned substantially coaxially with the tube until the applied torque reaches a level which causes the pivot arm to overcome the spring force and pivot, moving its inner end laterally to tip the trip block, camming the cam plunger rearwardly in the tube and allowing the inner end of the pivot arm to strike the inner surface of the tube, creating the click. When torque is released, the spring drives the parts back to their original positions.

While this arrangement works well, it has created several problems. When the trip block tips, it applies a lateral force against the front end of the cam plunger tending to cause its front end to move laterally more than the rear end, which can cause the front peripheral edge of the cam plunger to create surface galling of the inner surface of the tube as the cam plunger moves axially back and forth. Heretofore, this problem has been overcome by internal surface hardening of the tube through a heat-treating process. However, this heat treating process can cause distortion of the thin-walled tube and can create a significant degree of surface finish degradation. This surface finish damage and physical distortion of the tube then necessitates secondary processing operations to create surface finish and tube straightness, which add cost to the tool.

Furthermore, it has been found that in prior tools the lateral movement of the inner end of the pivot arm to create the click is sometimes sufficient to completely roll over the trip block or pawl so that it does not return to its proper position when torque is released. In order to alleviate this problem it has been necessary in prior designs to add a spacer ring press-fitted onto the end of the pivot arm to restrict the lateral or side-to-side movement of the pivot arm, thereby further adding cost to the tool.

SUMMARY

There is disclosed herein an improved click-type torque wrench and click mechanism therefore which avoid the disadvantages of prior techniques while affording additional structural and operating advantages.

An important aspect is the provision of a click mechanism which utilizes an improved cam assembly which effectively eliminates surface galling of the inner surface of the lever arm tube and obviates the use of a spacer on the pivot arm.

In an embodiment, a cam assembly for a click-type torque wrench includes an elongated plunger body having opposed ends and having a deep cavity formed axially in one end and terminating at an end face disposed intermediate the ends, the end face having a cam seat formed therein and extending laterally thereacross and having opposed sloping side cam surfaces.

In an embodiment, the cam assembly may be used in a click-type torque wrench which includes a tubular lever arm having a longitudinal axis, a pivot arm disposed within the lever arm for pivotal movement relative thereto and adapted to be coupled to a workpiece-engaging head, the plunger body being disposed within the lever arm for axial movement therealong and resiliently biased toward the pivot arm, and a trip block trapped between the seat and the distal end of the pivot arm for holding the pivot arm substantially coaxially within the lever arm and allowing it to pivot when a predetermined torque is reached.

The cam assembly may include a sleeve extending about the cam plunger for sliding engagement with the inner surface of the lever arm.

There is also disclosed a method of providing a click indication in a click-type torque wrench having a tubular lever arm and a pivot arm disposed within the lever arm, a cam plunger biased toward the distal end of the pivot arm and a trip block trapped between the cam plunger and the distal end of the pivot, the method comprising providing a deep axial cavity in the cam plunger into which the distal end of the pivot arm is received, and disposing the trip block at the inner end of the cavity.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 2:
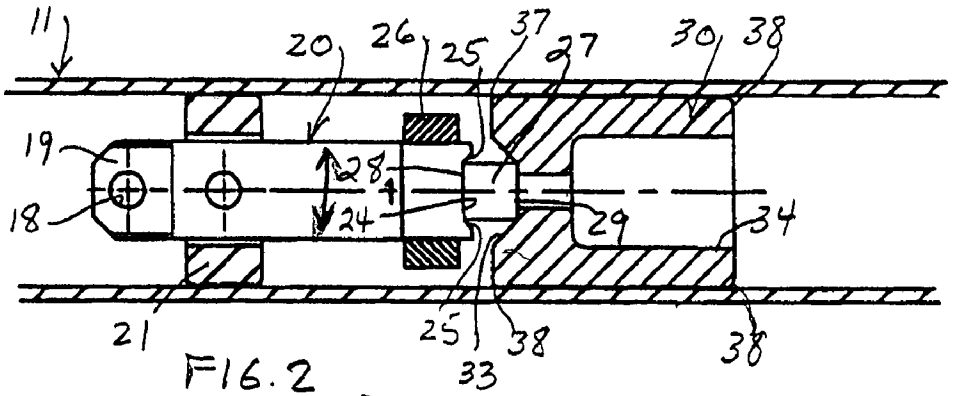
FIG. 2 (PRIOR ART)
FIG. 2 is a fragmentary horizontal sectional view through the torque wrench of FIG. 1.
Figure 1:
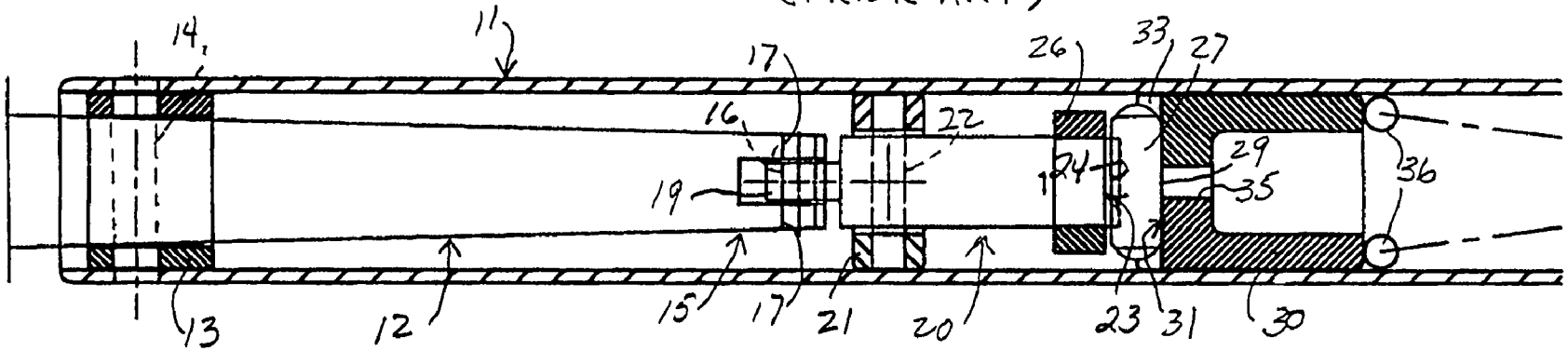
FIG. 1 (PRIOR ART)
FIG. 1 is a longitudinal vertical sectional view through a portion of a prior-art, click-type torque wrench.
Figure 4:
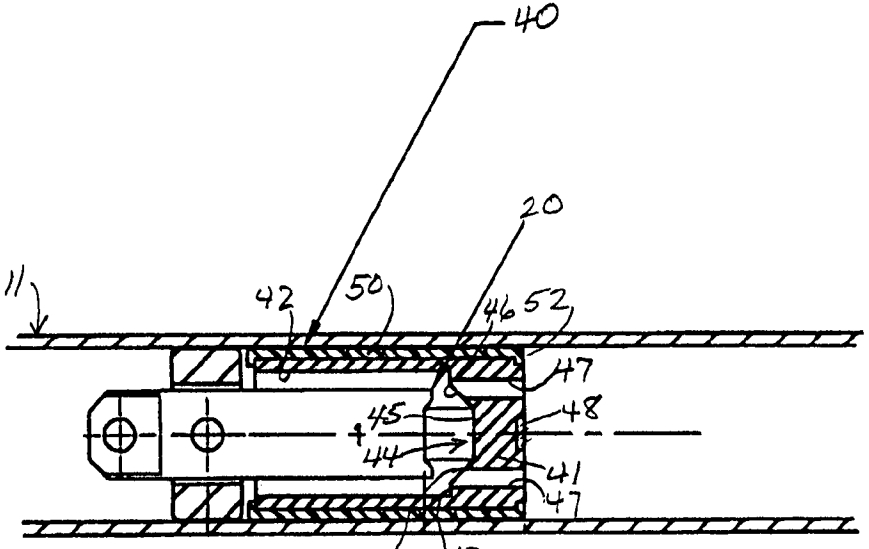
FIG. 4 is a view similar to FIG. 2 of the torque wrench of FIG. 3.
Figure 3:
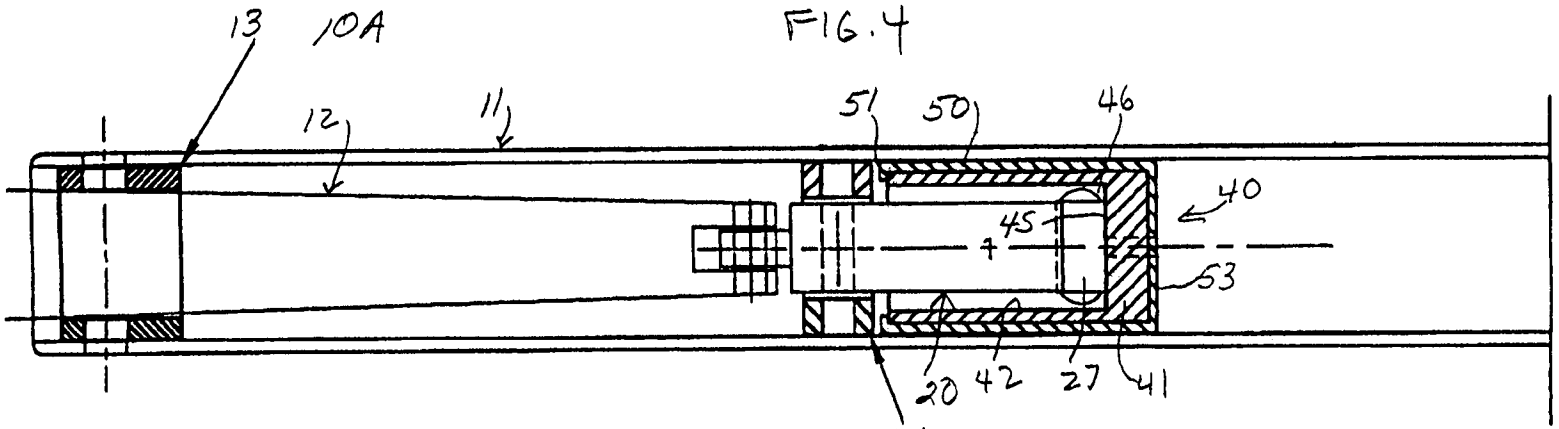
FIG. 3 is a view similar to FIG. 1 of an improved click-type torque wrench.
Figure 7:
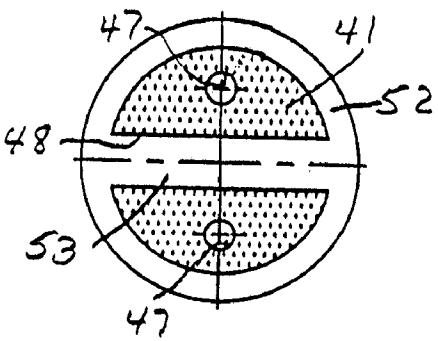
FIG. 7 is a right-hand end elevational view of the cam assembly of FIG. 5.
Figure 5:
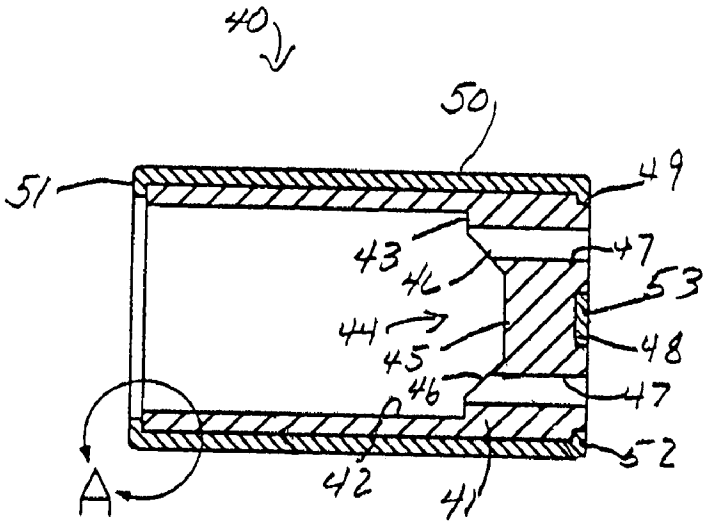
FIG. 5 is an enlarged sectional view taken along the same plane as FIG. 4 of the cam assembly of the torque wrench of FIG. 4.
Figure 6:
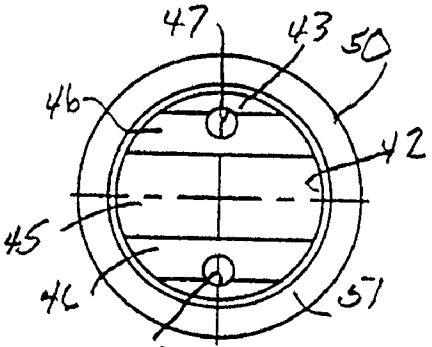
FIG. 6 is a left-hand end elevational view of the cam assembly of FIG. 5.

Referring to FIGS. 1 and 2, there is illustrated a portion or a prior-art torque wrench, generally designated by the numeral 10, having an elongated tubular lever arm 11. An elongated pivot arm 12 is received in one end of the lever arm 11, being mounted in a fulcrum block 13 for pivotal movement about the axis of a pivot pin 14. The outer or proximal end of the pivot arm 12 is adapted to be coupled to a workpiece-engaging head (not shown) in a known manner, which head could be ratcheting or non-ratcheting. The distal or inner end of the pivot arm 12 defines a clevis 15. A coupling pin 16 extends through aligned apertures 17 in the arms of the clevis 15 and also passes through a hole 18 in a tongue 19 of a secondary arm 20 to form a pivotal connection between the lever arm 11 and the secondary arm 20. The secondary arm 20, which may be cylindrical in shape, is mounted in a fulcrum block 21 for pivotal movement about the axis of a pivot pin 22. The use of two pivoting arms is necessary only in high-torque applications. In lower-torque applications only the pivot arm 20 may be necessary, in which case it would have the appropriate length and be directly connected to the workpiece-engaging head. Such a torque wrench is disclosed, for example, in U.S. Pat. No. 3,599,515, the disclosure of which is incorporated herein by reference.

Extending diametrically across the inner or distal end face of the secondary arm 20 is a seat recess 23 having a flat base surface 24 and opposed sloping side surfaces 25. An annular stop ring 26 may be press-fitted on the distal end of the secondary arm 20 to limit lateral pivotal movement of the inner end of the secondary arm 20. A pawl or trip block 27 is seated in the recess 23. The pawl 27 may be an elongated block which is substantially square in transverse cross section with rounded ends, having opposed flat faces 28 and 29, with the face 28 being normally seated against the base surface 24 of the seat recess 23.

The wrench 10 also includes a cam plunger 30, which may be a substantially cylindrical block disposed for coaxial sliding movement within the lever arm 11 and having a pawl slot 31 extending diametrically across the forward or inner face thereof. The pawl slot 31 is shaped generally like the seat recess 23, having a flat base surface 32 and opposed side surfaces 33. The flat face 29 of the pawl 27 seats against the base surface 32. The rear or outer end of the cam plunger 30 is hollowed out to define a deep cylindrical cavity 34 which communicates with the pawl slot 31 through a relatively small-diameter vent hole 35. The hole 35 avoids differential pressure which could occur due to possible sealing from lubrication grease within the wrench assembly, which differential pressure could cause variation in torque readings. The cam plunger 30 is biased forwardly, toward the secondary arm 20, by a bias spring 36, which may be a helical compression spring having one end thereof seated against the rear end of the cam plunger 30 and the other end seated against an adjustment mechanism (not shown) for adjusting the pre-compression of the spring and, thereby, the predetermined torque level at which the wrench is designed to "click." The spring pressure holds the pawl 27 seated firmly against the seat recess 23 of the secondary arm 20, thereby holding the secondary arm 20 in a normal rest configuration substantially coaxial with the lever arm 11.

When torque is applied to a workpiece with the wrench 10, the torque tends to try to pivot the pivot arm 12 and, thereby, the secondary arm 20, but this pivotal movement is resisted by the spring pressure on the cam plunger 30. When the predetermined torque level is reached, the spring pressure is overcome and the arms 11 and 20 pivot, e.g., in the direction of the arrow in FIG. 2, thereby tipping the pawl 27 and moving the cam plunger 30 rearwardly against the urging of the bias spring 36, the pivotal movement of the inner end of the secondary arm 20 being limited by engagement of the stop ring 26 with the inner side of the tubular lever arm 11 so that the pawl 27 will not roll over, all in a known manner. When the torque is released, the cam plunger 30 is driven back forwardly, resetting the pawl 27 and the secondary arm 20 in their original aligned positions.

When the secondary arm 20 pivots and the pawl 27 tips, a lateral force is applied to the front end of the cam plunger 30. Since this lateral force is concentrated at the front end of the cam plunger 30, it tends to try to tilt the cam plunger about its center of gravity so that, as the cam plunger 30 moves axially back and forth, its front edge may tend to gall the inner surface of the tubular lever arm 11, as at 37 and 38.

Referring now to FIGS. 3–7, there is illustrated a modified torque wrench 10A, in which the cam plunger 30 has been replaced by a cam assembly 40 and the stop ring 26 has been eliminated. All other parts of the torque wrench 10A are the same as those in the wrench 10, so that like parts have the same reference numbers.

The cam assembly 40 includes an elongated cylindrical cam plunger 41, having formed axially in the forward end surface thereof a deep cylindrical bore or cavity 42 which terminates at a circular end face 43, which is disposed in the rear half of the cam plunger 41. Formed diametrically across the end face 43 is a pawl slot 44, having a flat base surface 45 and opposed sloping side surfaces 46. Formed in the rear end face of the cam plunger 41 are two vent holes 47 which extend parallel to the axis of the cam plunger 41 on opposite sides thereof and respectively intersect the sloping side surfaces 46 for communication with the cavity 42. Formed in the rear end face of the cam plunger 41 and extending diametrically thereacross midway between the vent holes 47 is a shallow channel 48. Also formed in the end face of the cam plunger 41 at the periphery thereof is an annular recess 49.

The cam assembly 40 also includes a cylindrical sleeve 50, which covers the outer cylindrical surface of the cam plunger 41, the sleeve 50 having an annular front lip 51 which overlaps the front end surface of the cam plunger 41 and a rear peripheral lip 52 which seats in the annular recess 49. The sleeve 50 may also include a cross arm 53 which extends diametrically across the rear end thereof and fills the channel 48 of the cam plunger 41. The sleeve 50 may be formed of a plastic material, such as a suitable friction-reducing polymer material, such as molybdenum-disulfide nylon, and may be overmolded on the cam plunger 41. Alternatively, the sleeve 50 could be preformed and then fitted over the cam plunger 41. The sleeve 50 could be formed of other materials, such as brass or other metals, or non-metals. The material of the sleeve 50 may be selected so that the outer surface of the sleeve 50 has a friction-reducing character and may be selected to have a hardness relative to that of the lever arm 11 so as to inhibit galling of the inner surface of the lever arm 11.

The operation of the torque wrench 10A is substantially the same as that described above with respect to the torque wrench 10. However, the friction-reducing sleeve 50 significantly reduces part-to-part wear which had been associated with prior torque wrenches at the metal-to-metal interface between the prior cam plunger and the inner surface of the tubular lever arm 11. This reduced wear also significantly increases the life expectancy of the product. Also, because the pawl seat 44 is disposed well within the cam plunger 41, the side load forces on the cam plunger 41 resulting from pivoting of the secondary arm 20 are much more evenly distributed along the length of the cam plunger 41, greatly reducing the tendency of the cam assembly 40 to tend to gall the inner surface of the lever arm 11. This tendency may be even further reduced by the presence of a friction-reducing sleeve 50. Thus, there is no need for surface hardening of the internal surface of the lever arm 11. Also, the cavity 42 is dimensioned to have a diameter only slightly greater than that of the secondary arm 20. Thus, the lateral movement of the inner end of the secondary arm 20 is limited to an extent such that rollover of the pawl 27 is prevented, so that the stop ring 26 is not necessary. The seating of the cross arm 53 of the sleeve 50 in the channel 48 inhibits any tendency toward rotational movement of the sleeve 50 relative to the cam plunger 41.

The cam plunger 41 may be formed of a suitable metal, such as a powdered metal, and the other parts of the torque wrench 10A may also be formed of suitable metals, although it may be possible to use other materials for some or all of these parts.

While particular embodiments have been shown and described, it will be apparent to those skilled in the art that changes and modifications may be made without departing from the principles of the ratcheting torque angle wrench in its broader aspects. The matter set forth in the foregoing description and accompanying drawings is offered by way of illustration only and not as a limitation.

What is claimed is:

1. A click-type torque wrench comprising:

a tubular lever arm having a longitudinal axis, a pivot arm disposed within the lever arm for pivotal movement relative thereto and adapted to be coupled to a workpiece-engaging head, a cam plunger disposed within the lever arm for axial movement therealong and resiliently biased toward the pivot arm, the plunger having opposed ends and a deep cavity formed axially in one end and terminating in a seat disposed intermediate the ends, the cavity receiving a distal end of the pivot arm therein, and a trip block trapped between the seat and the distal end of the pivot arm for holding the pivot arm substantially coaxially within the lever arm and allowing it to pivot only when a predetermined torque is reached.

2. The torque wrench of claim 1, and further comprising a sleeve disposed about the cam plunger in sliding engagement with the tubular lever arm.

3. The torque wrench of claim 2, wherein the sleeve is formed of a friction-reducing material.

4. The torque wrench of claim 2, wherein the sleeve is formed of a plastic material.

5. The torque wrench of claim 2, wherein the sleeve is provided at opposite ends thereof with radially inwardly extending annular flanges respectively overlapping adjacent end surfaces of the cam plunger.

6. The torque wrench of claim 1, wherein the cam plunger has vent holes formed in the closed end thereof communicating with the cavity.

7. A click-type torque wrench comprising:

a tubular lever arm having a longitudinal axis, a pivot arm disposed within the lever arm for pivotal movement relative thereto and adapted to be coupled to a workpiece-engaging head, a cam plunger disposed within the lever arm for axial movement therealong and resiliently biased toward the pivot arm, the plunger having a seat formed thereon, a trip block trapped between the seat and a distal end of the pivot arm for holding the pivot arm substantially coaxial with the lever arm and allowing it to pivot only when a predetermined torque is reached, and a sleeve disposed about the cam plunger in sliding engagement with the tubular lever arm, the sleeve including at the opposite ends thereof radially inwardly extending annular flanges respectively overlapping adjacent end surfaces of the cam plunger.

8. A click-type torque wrench comprising:

a tubular lever arm having a longitudinal axis, a pivot arm disposed within the lever arm for pivotal movement relative thereto and adapted to be coupled to a workpiece-engaging head, a cam plunger disposed within the lever arm for axial movement therealong and resiliently biased toward the pivot arm, the plunger having opposed ends and a deep cavity formed axially in one end, the cavity receiving a distal end of the pivot arm therein for holding the pivot arm substantially coaxial with the lever arm and allowing it to pivot only when a predetermined torque is reached; and a sleeve disposed about the cam plunger in sliding engagement with the tubular lever arm.

9. The torque wrench of claim 8, wherein the sleeve is formed of a friction-reducing material.

10. The torque wrench of claim 8, wherein the sleeve is formed of a plastic material.

11. The torque wrench of claim 8, wherein the sleeve is formed of a metal material.

* * * * *